US007127843B2

(12) United States Patent
Swank

(10) Patent No.: US 7,127,843 B2
(45) Date of Patent: Oct. 31, 2006

(54) FOLDABLE CARD ASSEMBLY FOR DISPLAYING SELECTED PHOTOS OR THE LIKE

(76) Inventor: Ronald N. Swank, 3074 SE. Marion St., Albany, OR (US) 97322

( * ) Notice: Subject to any disclaimer, the term of this patent is extended or adjusted under 35 U.S.C. 154(b) by 273 days.

(21) Appl. No.: 10/825,834

(22) Filed: Apr. 16, 2004

(65) Prior Publication Data

US 2005/0229448 A1 Oct. 20, 2005

(51) Int. Cl.
*G09F 1/04* (2006.01)

(52) U.S. Cl. ..... 40/124.09; 40/539

(58) Field of Classification Search ..... 40/124.09, 40/439, 427; 272/155, 153 R, 157 R; 446/487
See application file for complete search history.

(56) References Cited

U.S. PATENT DOCUMENTS 2,878,607 A 3/1959 Alves
3,713,238 A 1/1973 Hyman
4,825,572 A 5/1989 Altman Robbins
4,890,402 A 1/1990 Carroll
5,759,328 A * 6/1998 Richwine et al. ..... 156/227
5,833,789 A * 11/1998 Rosendale et al. ..... 156/227
6,216,378 B1 4/2001 Roberto
6,679,493 B1 * 1/2004 Stephenson ..... 273/155
2002/0095914 A1 7/2002 Gerrie

* cited by examiner

*Primary Examiner*—Cassandra Davis

(57) ABSTRACT

A card assembly for selectively displaying photos or the like, which is normally in a folded state such that at least one of the photos or the like is then hidden from view, but which upon being unfolded into an open state will permit the normally hidden photo or the like to then be visibly displayed.

2 Claims, 18 Drawing Sheets

Fig 5 (starting from the back)

Fig 11 (from the back)

Fig 16 (back side as normally viewed - upside down flip from front view)
Compare position of scissors from scissor position in Fig 15 to clarify.

FOLDABLE CARD ASSEMBLY FOR DISPLAYING SELECTED PHOTOS OR THE LIKE

FIELD OF THE INVENTION

This invention relates to visual display apparatus for displaying photos or the like.

BACKGROUND OF THE INVENTION

One thing that most people would enjoy is to have the opportunity to occasionally look at selected photos or the like, without having to be inconvenienced by any mechanical details associated with that process.

PRIOR ART

Relevant prior art includes U.S. Pat. No. 2,878,607 issued in 1959 to Alves for a Photo-Mount Greeting Card.

SUMMARY OF THE INVENTION

According to the present invention I provide a foldable card assembly comprising a generally rectangular front card member that is divided to form two separate front card pieces of equal size and shape, and a back support card member of essentially the same size and shape as each of the separate front card pieces. The back support card member has its respective side edges hingedly secured to the lateral centers of respective ones of the front card pieces. The front card pieces normally occupy a common plane in front of the back card member, but may be rotated by one hundred eighty degrees relative to each other and to the back card member, to then occupy a common plane behind the back support card member.

It is convenient to visibly display a first photo as a unit on the front card member, with two separate portions of the first photo being then supported on respective front card pieces. At the same time a second photo may be displayed on the back surface of the back card member. Then when the front card pieces are rotated by one hundred eighty degrees relative to each other and to the back card member, the front surface of the back card support member together with the now forwardly exposed surfaces of the adjacent inner portions of the front card pieces may collectively support a third photo visibly displayed as a unit.

According to the invention the preferred method of providing hinged support by the back support card member for the front card pieces is to provide the back support member with protruding ends that protrude beyond the hinge lines, fold the back support member along the hinge lines, and then glue or otherwise secure the protruding end portions of the back support card member to the back surfaces of respective outer portions of the front card member. As a result, there are then two areas on the back surfaces of the respective front card pieces, and two areas on the front surface of the respective protruding portions of the back support card member, that will not be used to support a photo or the like. Their surfaces will not be visible to the user of the product because they are secured together in a face-to-face engagement.

In the preferred embodiment of my invention a feature of particular interest is that a wallet-size photo holder may be used to display two photos that are readily visible, plus another that is normally hidden from view. Other features of my invention provide other folding actions to make it possible for the same easily transportable package to visibly display selected ones of more than three different photos or the like.

DRAWING SUMMARY

Figure 1:
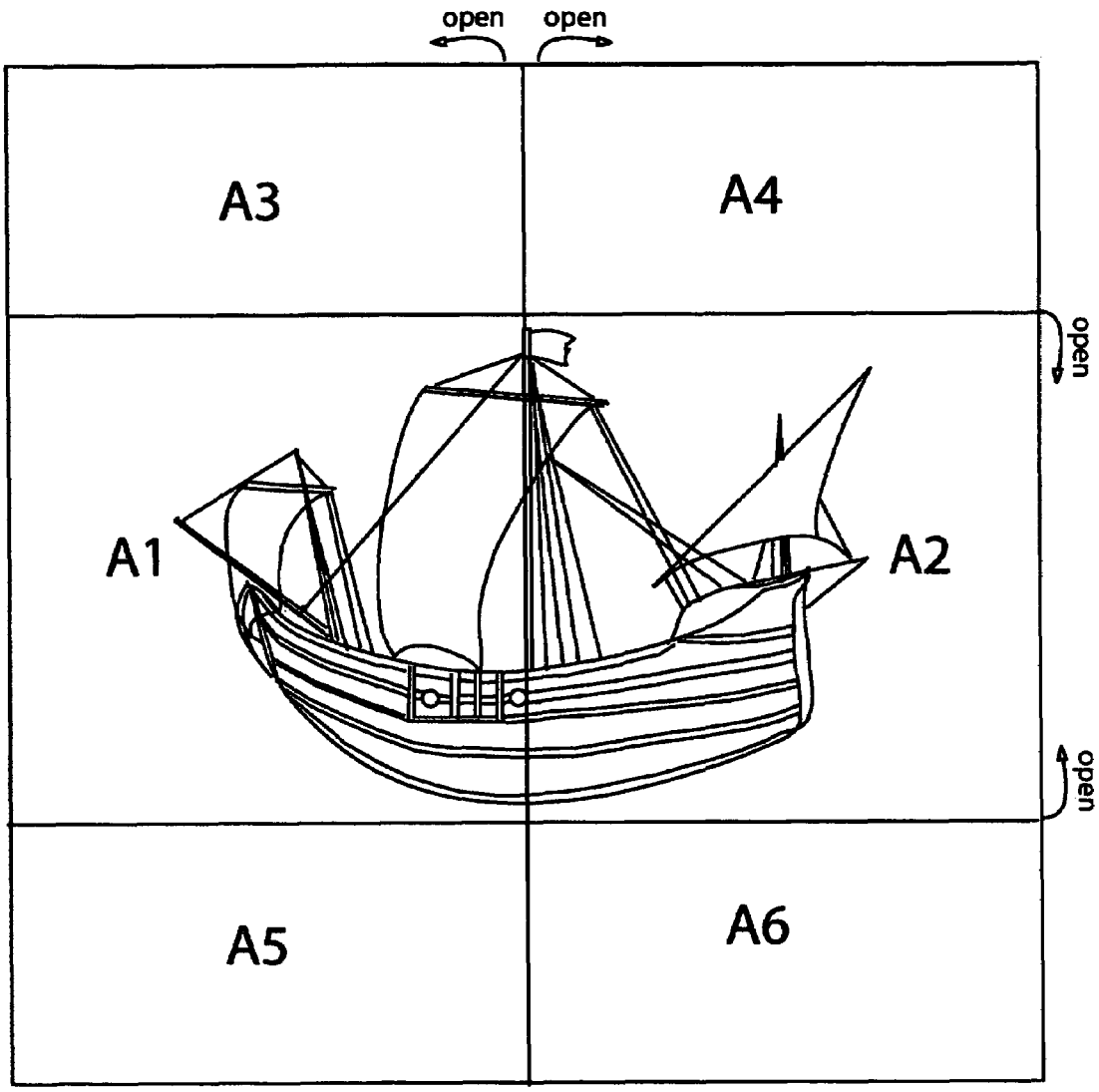
FIG. 1 is a front view of my novel foldable card assembly in its normal unfolded state, in which only the front surface of the front card member is visible, and which is also the point of commencement for Step 1 of FIG. 9.
Figure 2:
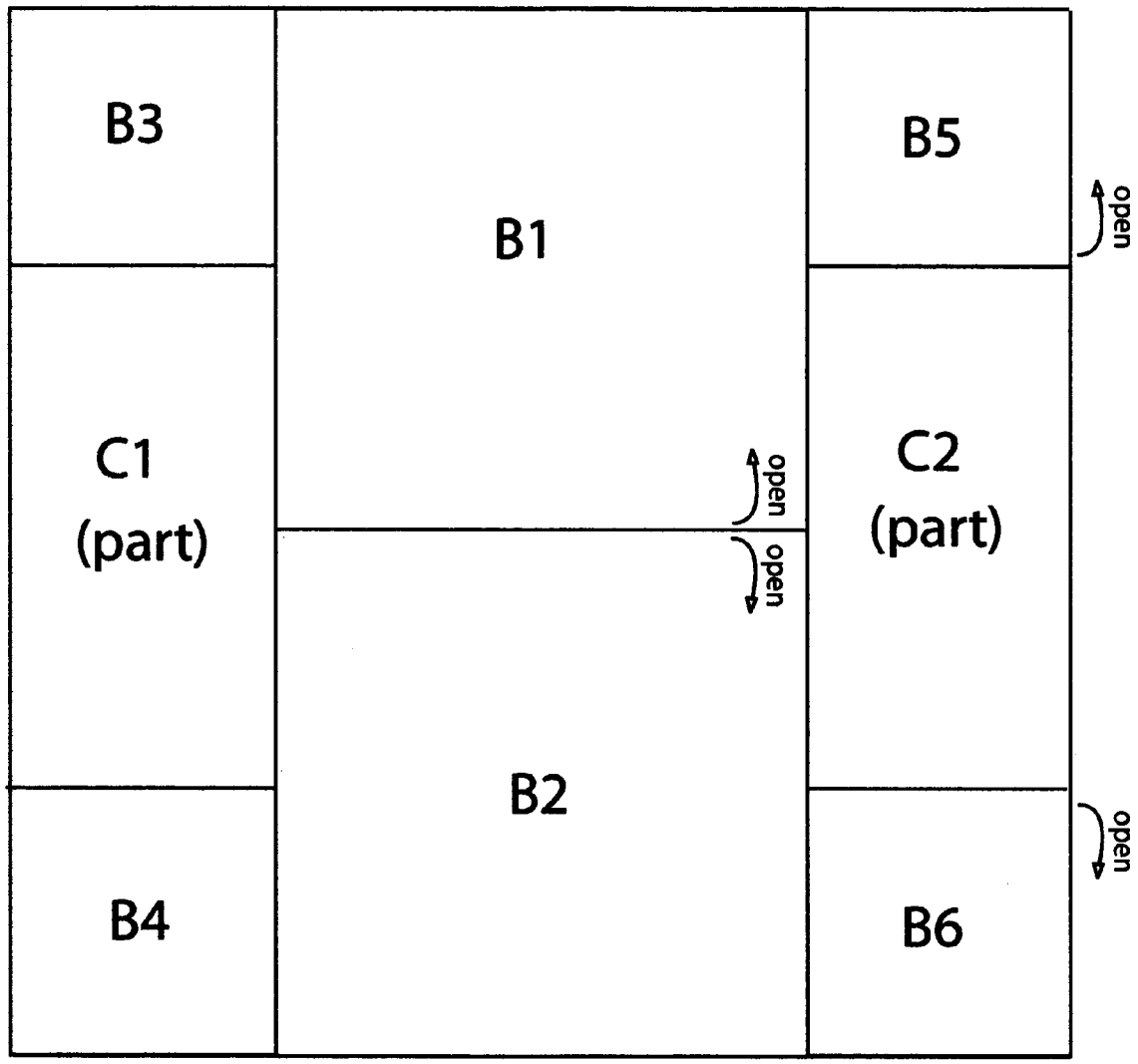
FIG. 2 is a view of the front of the assembly after Step 1 of FIG. 9, when it has been partially unfolded by separating the two separate front card pieces on the vertical cut line between them, and also rotating them one hundred eighty degrees about their respective vertical axes.
Figure 3:
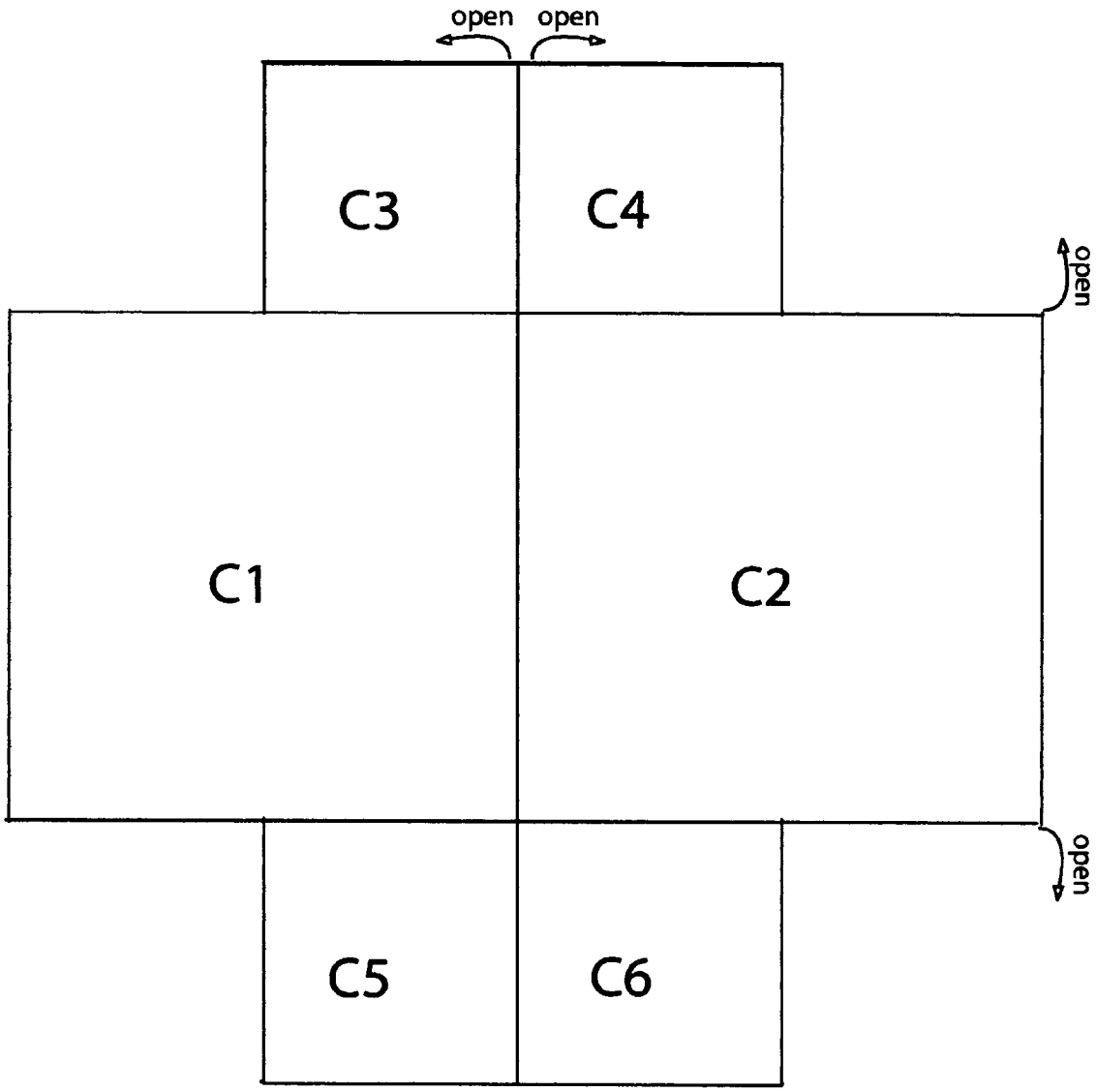
FIG. 3 is a front view of the assembly in a further unfolded state after Step 2 of FIG. 9, when its upper and lower quarters have been rotated one hundred eighty degrees on respective horizontal fold lines.
Figure 4:
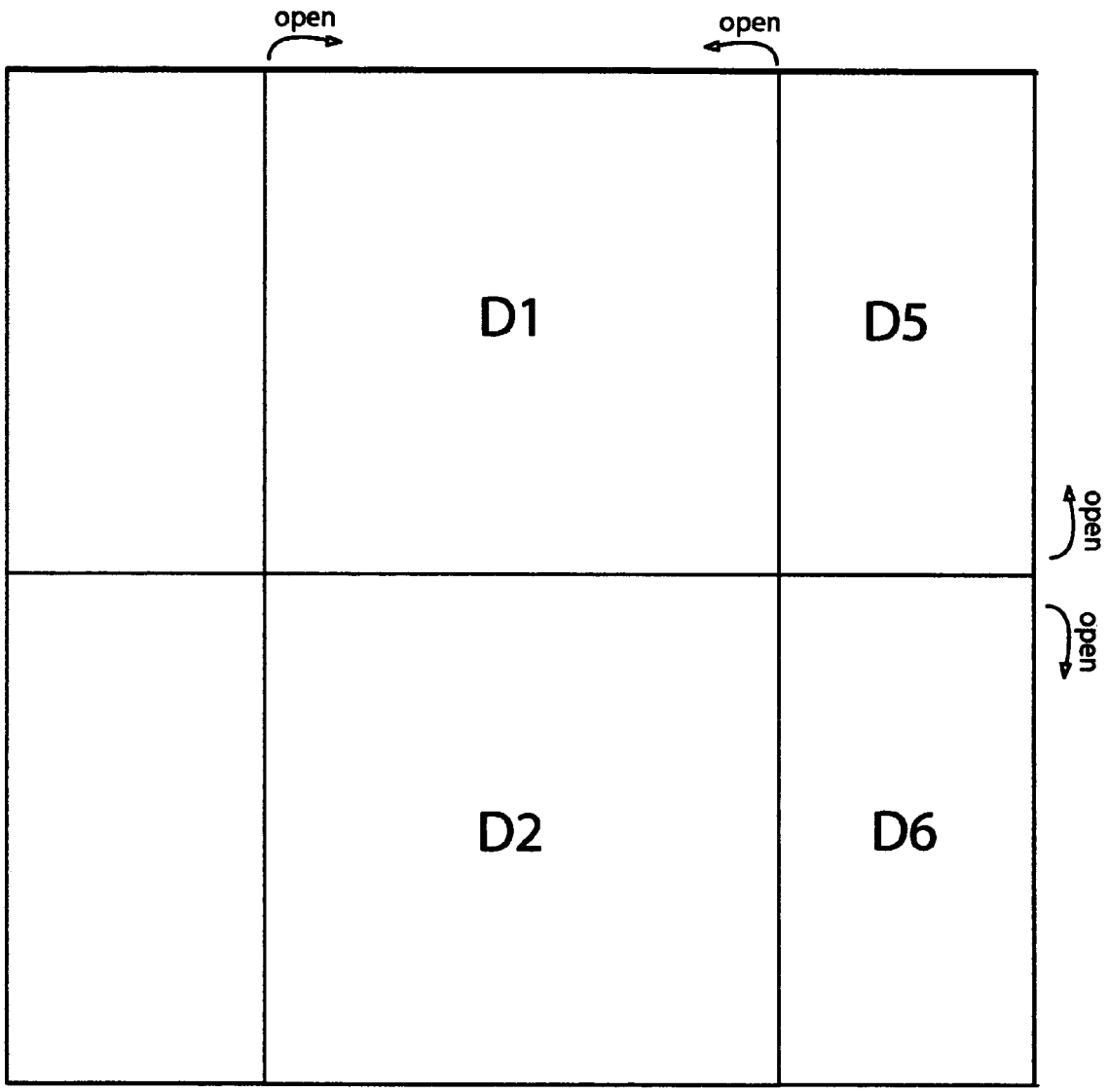
FIG. 4 is a front view of the assembly after Step 3 of FIG. 9 has been completed, and prior to the commencement of Step 4.
Figure 5:
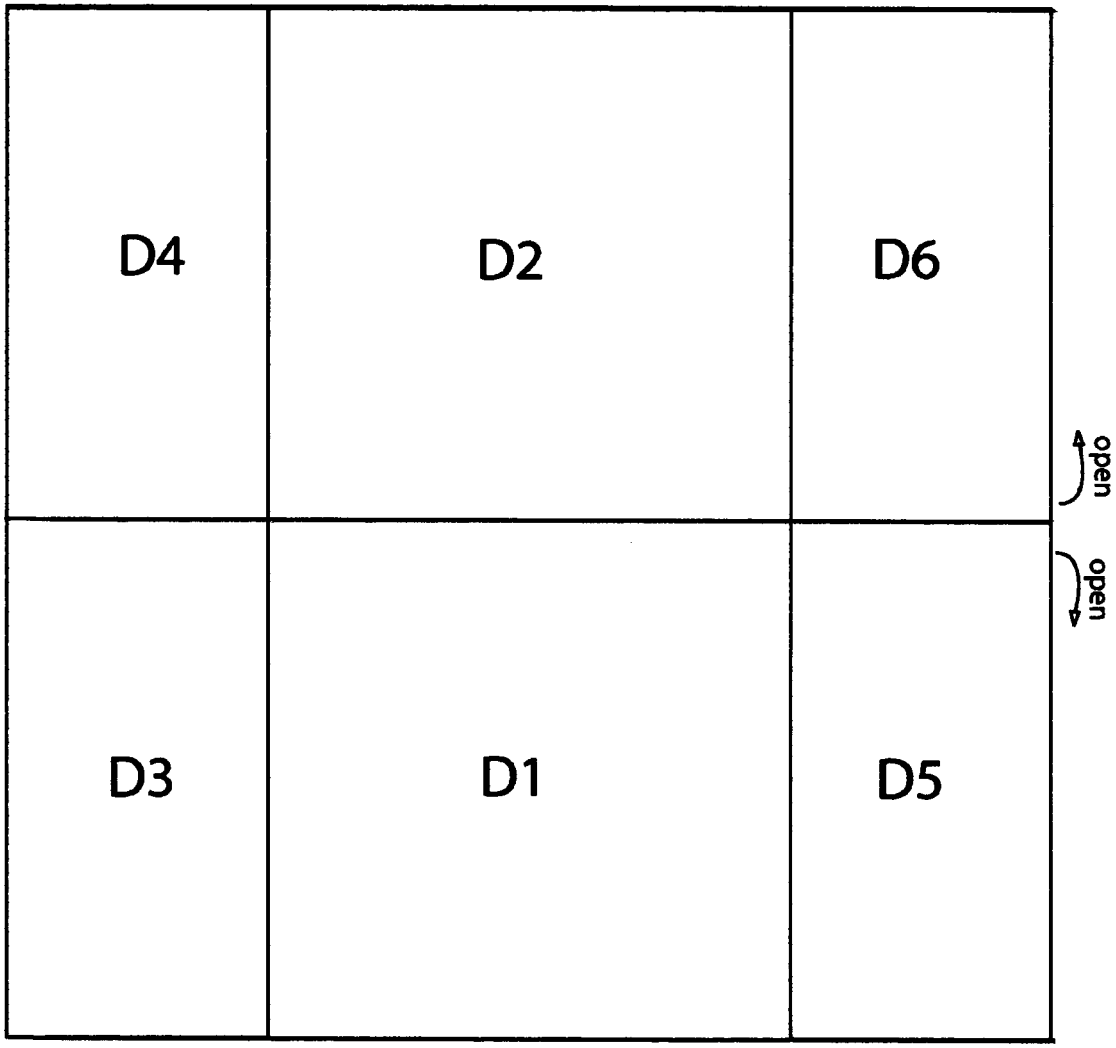
FIG. 5 is a view of the back side of the assembly in its normal unfolded state, showing only the back surface of the back support card member, and which also conforms to the starting position for Step 1 of FIG. 11.
Figure 6:
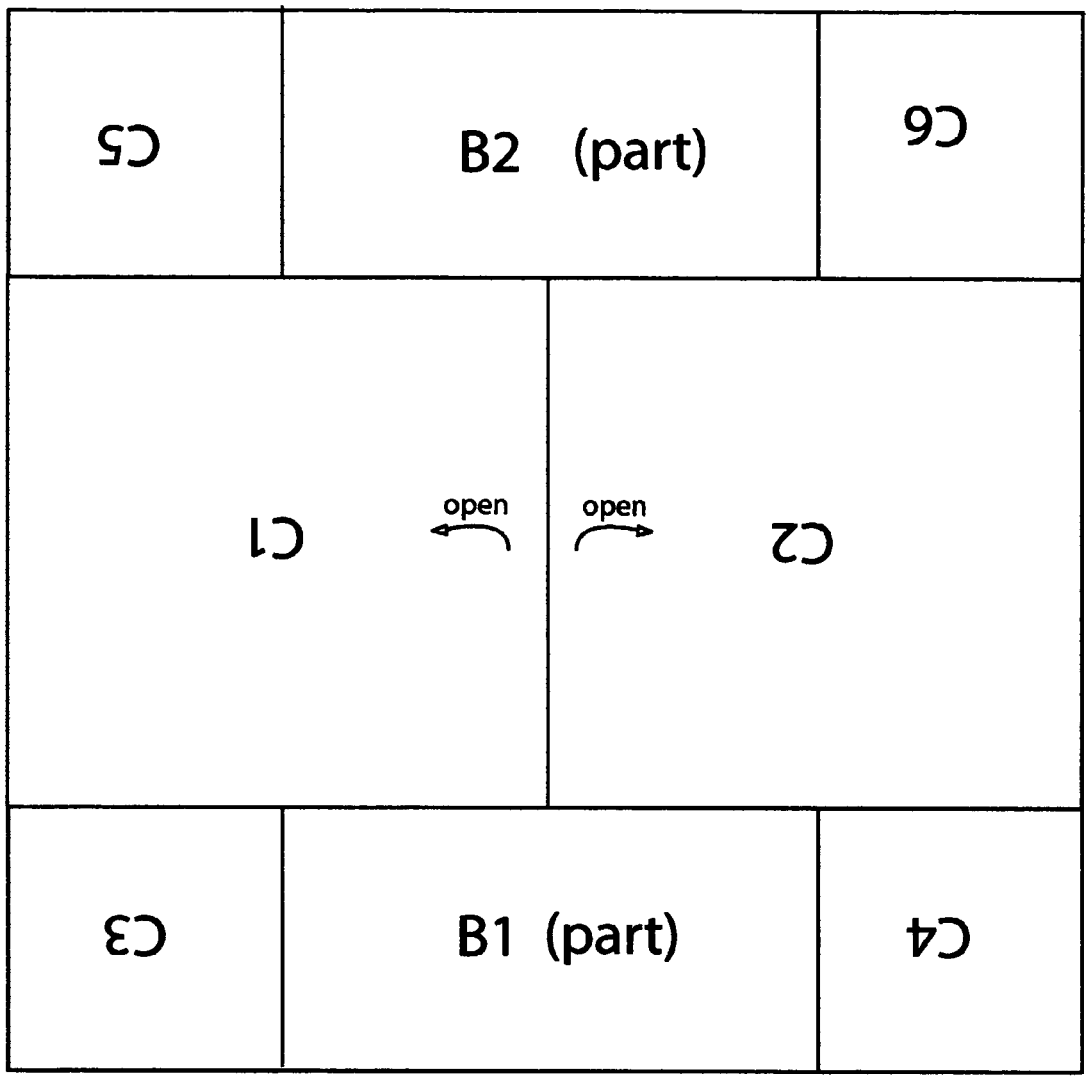
FIG. 6 is a view of the assembly from its back side, after Step 1 of FIG. 11 has been achieved by rotating upper and lower parts by one hundred eighty degrees on a horizontal fold line between them.
Figure 7:
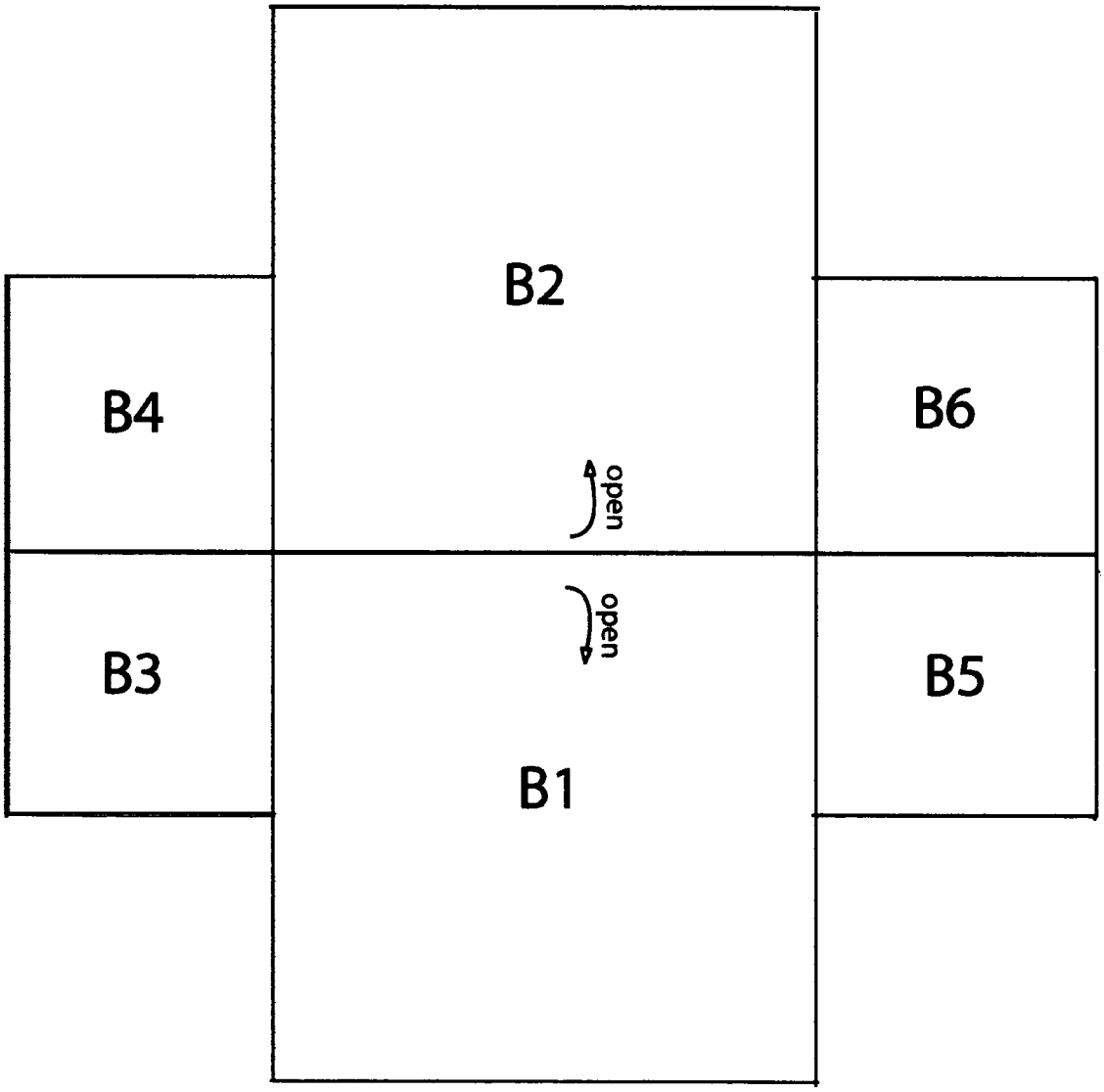
FIG. 7 is a view of the back side of the assembly after Step 2 of FIG. 11 has been completed, by separating two central portions of the assembly on a vertical separation line between them and at the same rotating left and right quarter portions of the assembly on respective vertical fold lines, to then assume the position shown in Step 3 of FIG. 11.
Figure 8:
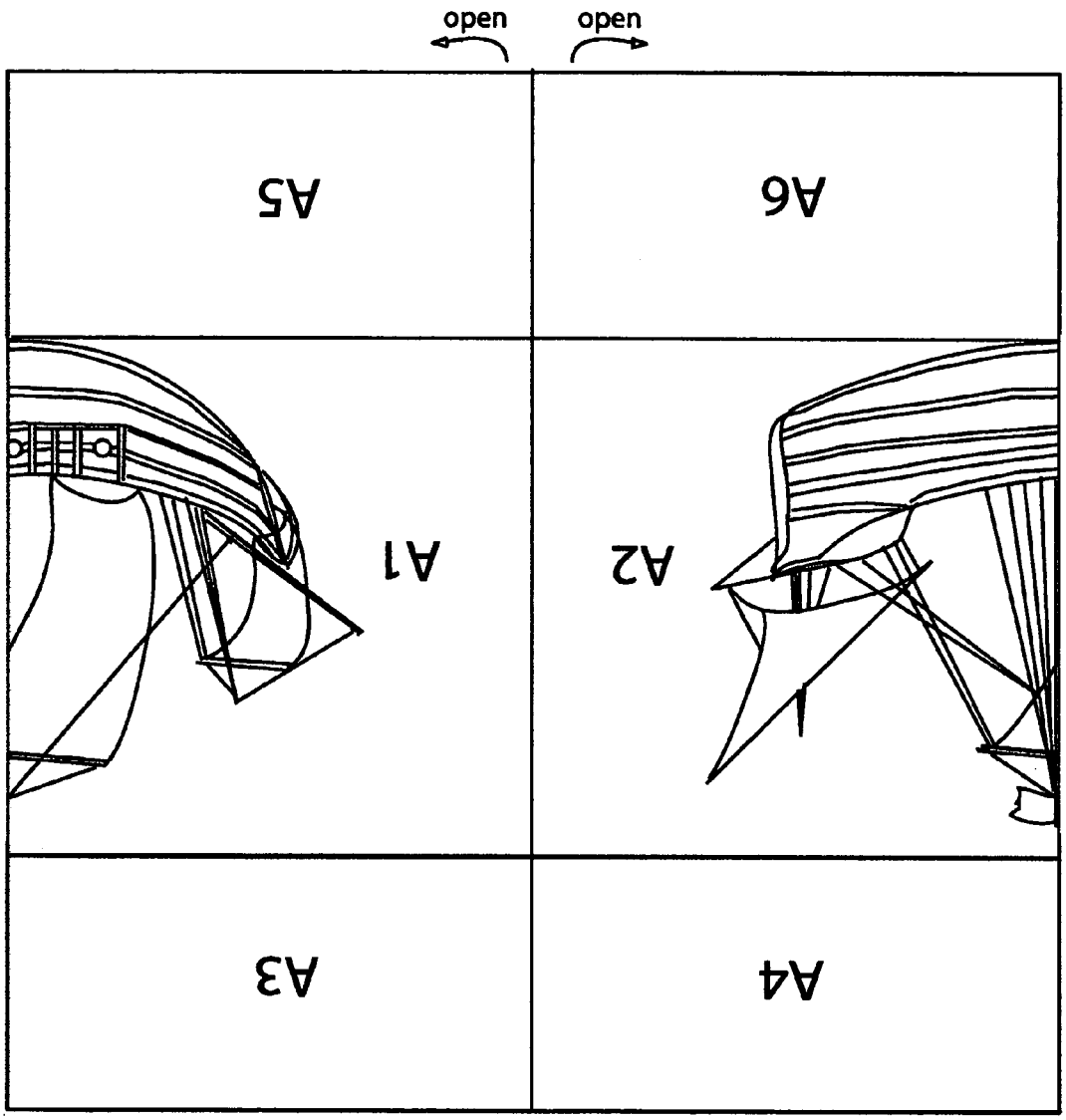
FIG. 8 is a view of the back side of the assembly after Step 3 of FIG. 11 has been completed.
Figure 9:
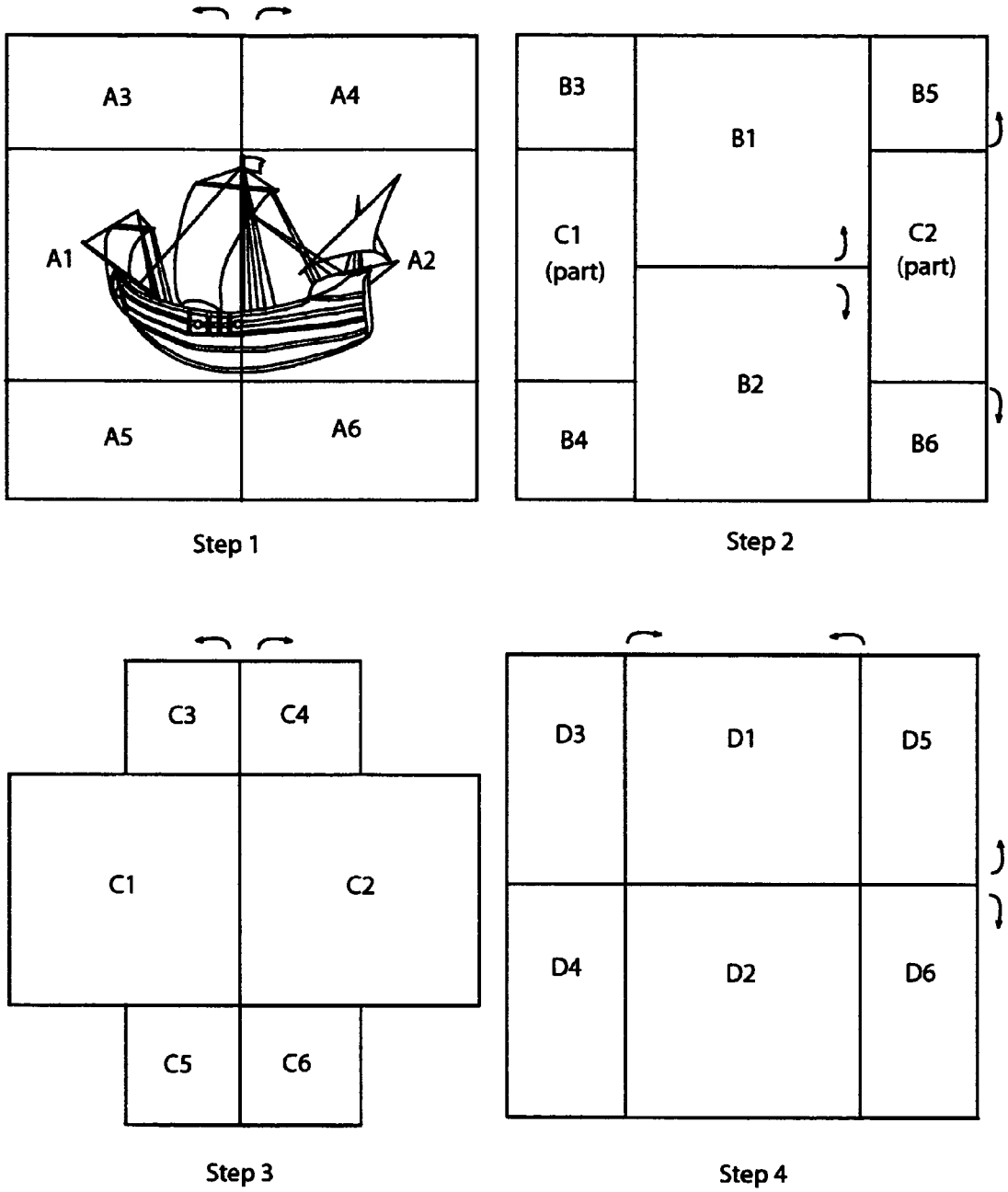
FIG. 9 shows the sequence of unfolding steps from the FIG. 1 state into the FIG. 2 state and then into the FIG. 3 state and then into the FIG. 4 state.
Figure 10:
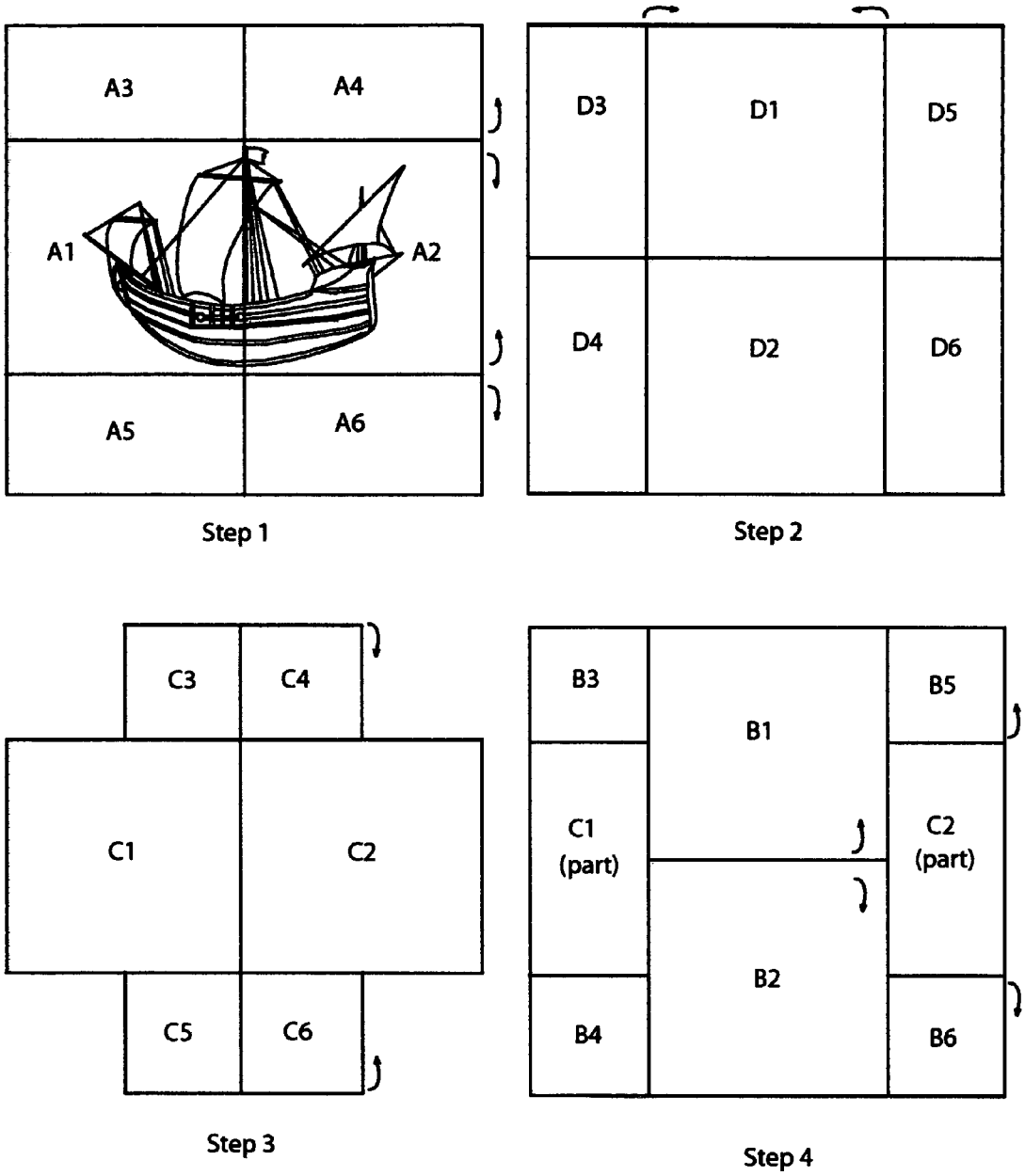
Figure 11:
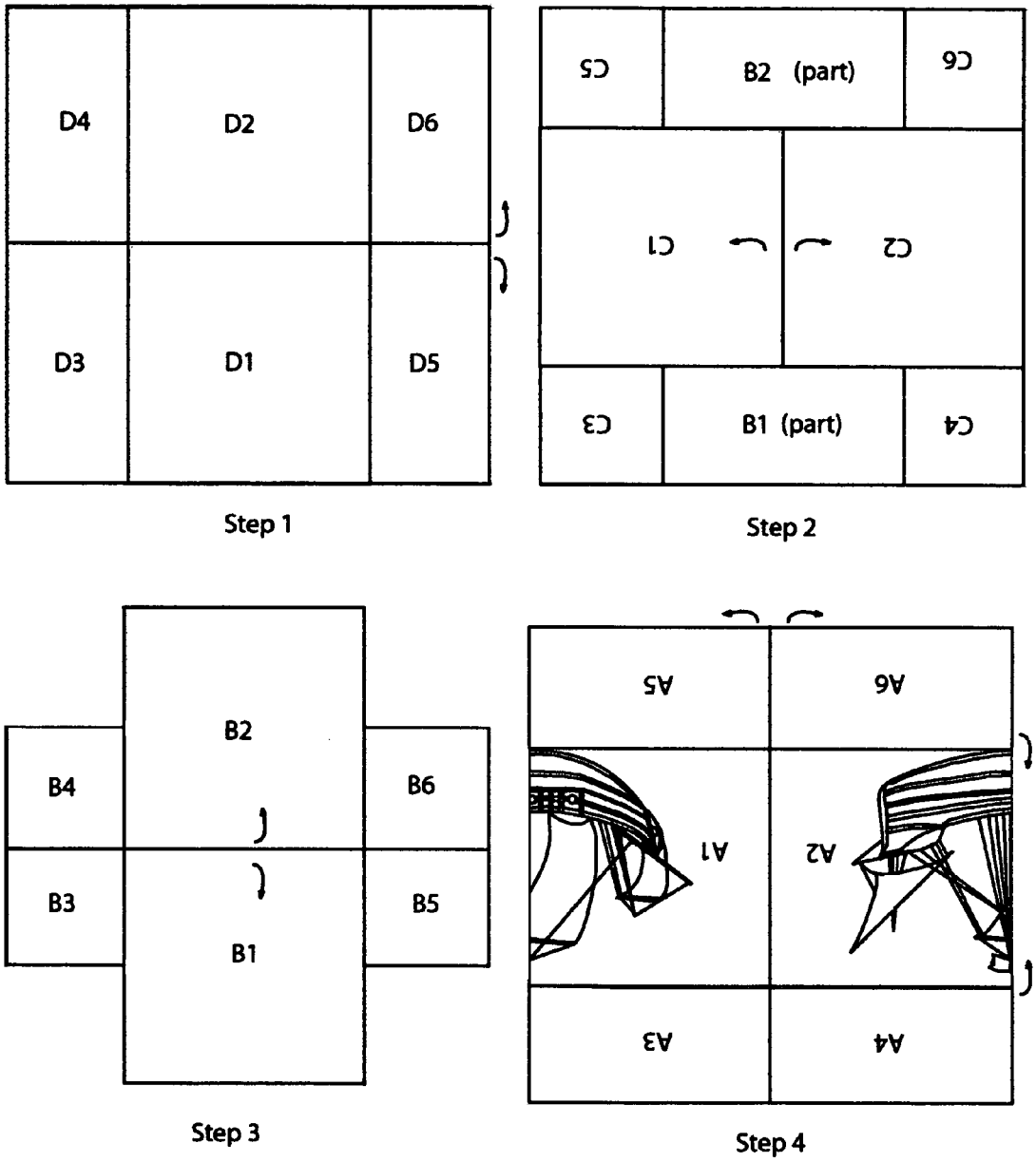
Figure 12:
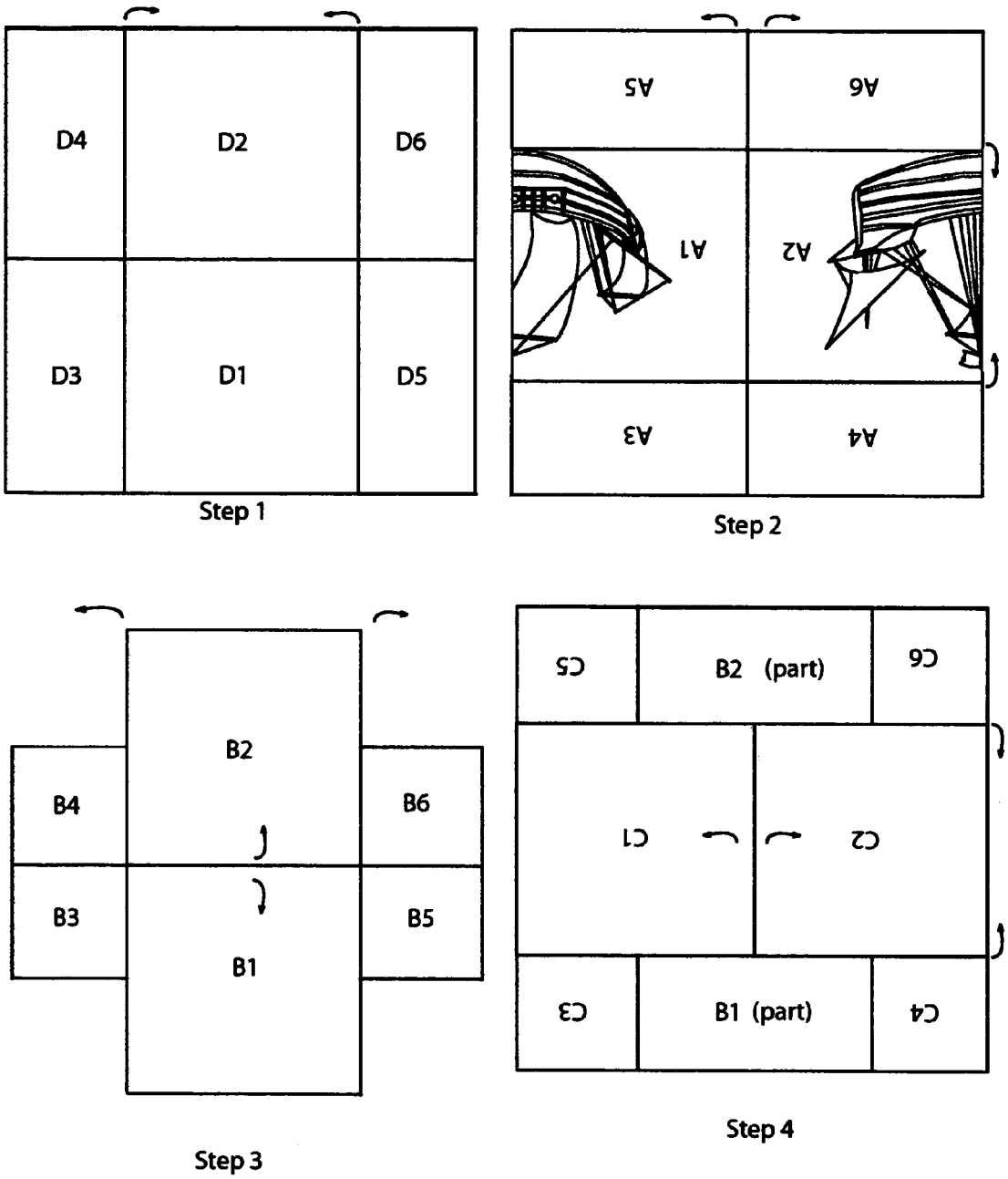
Figure 13:
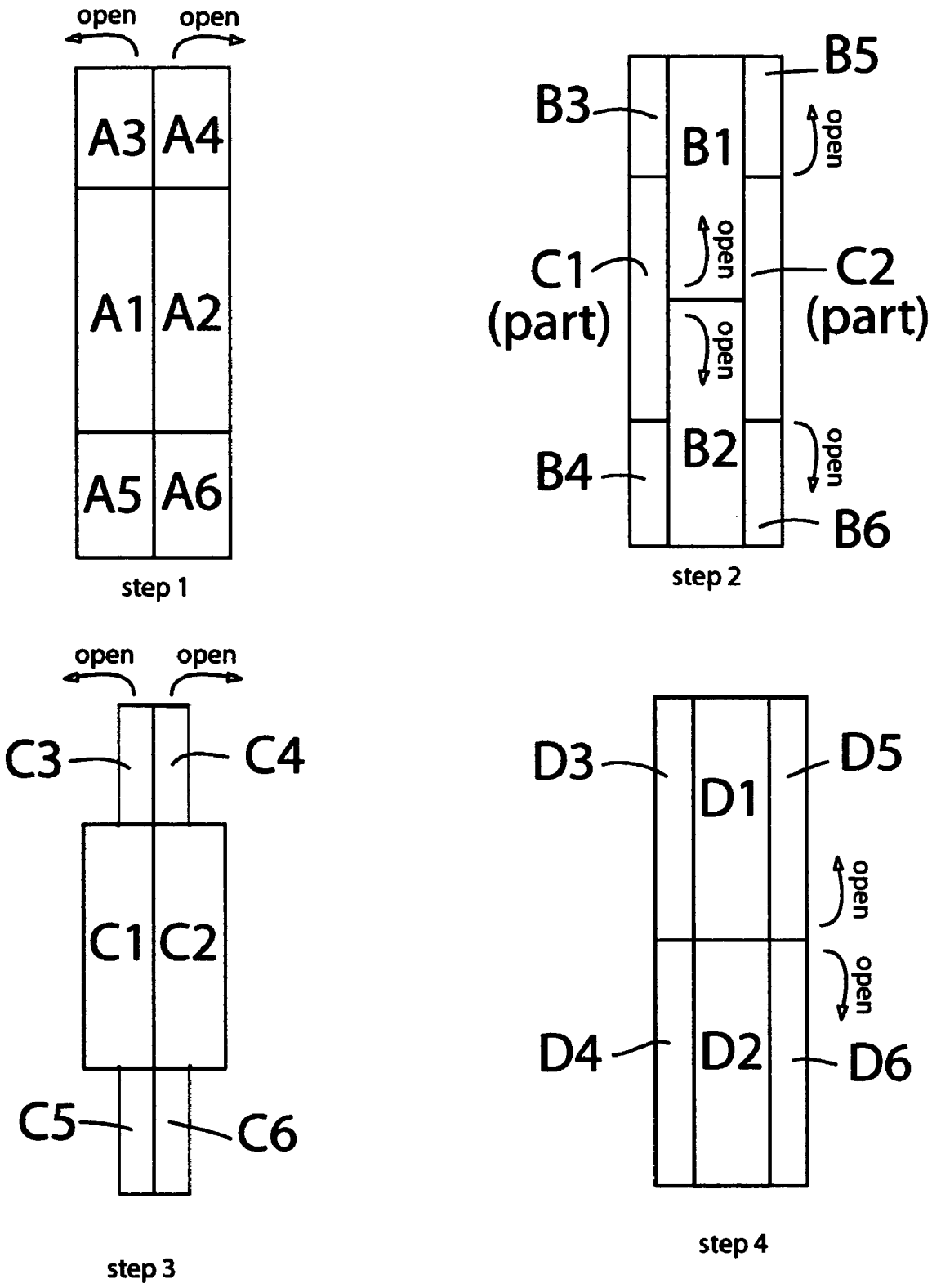
Figure 14:
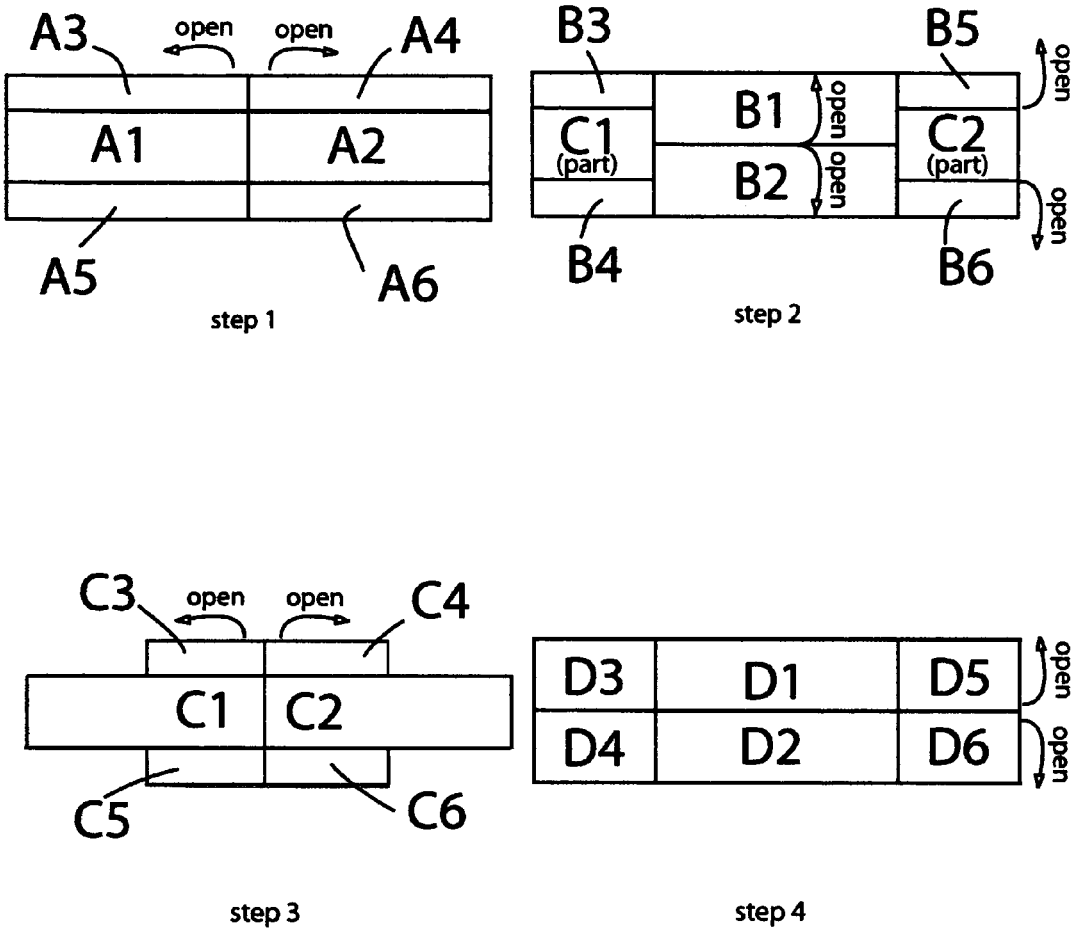
Figure 15:
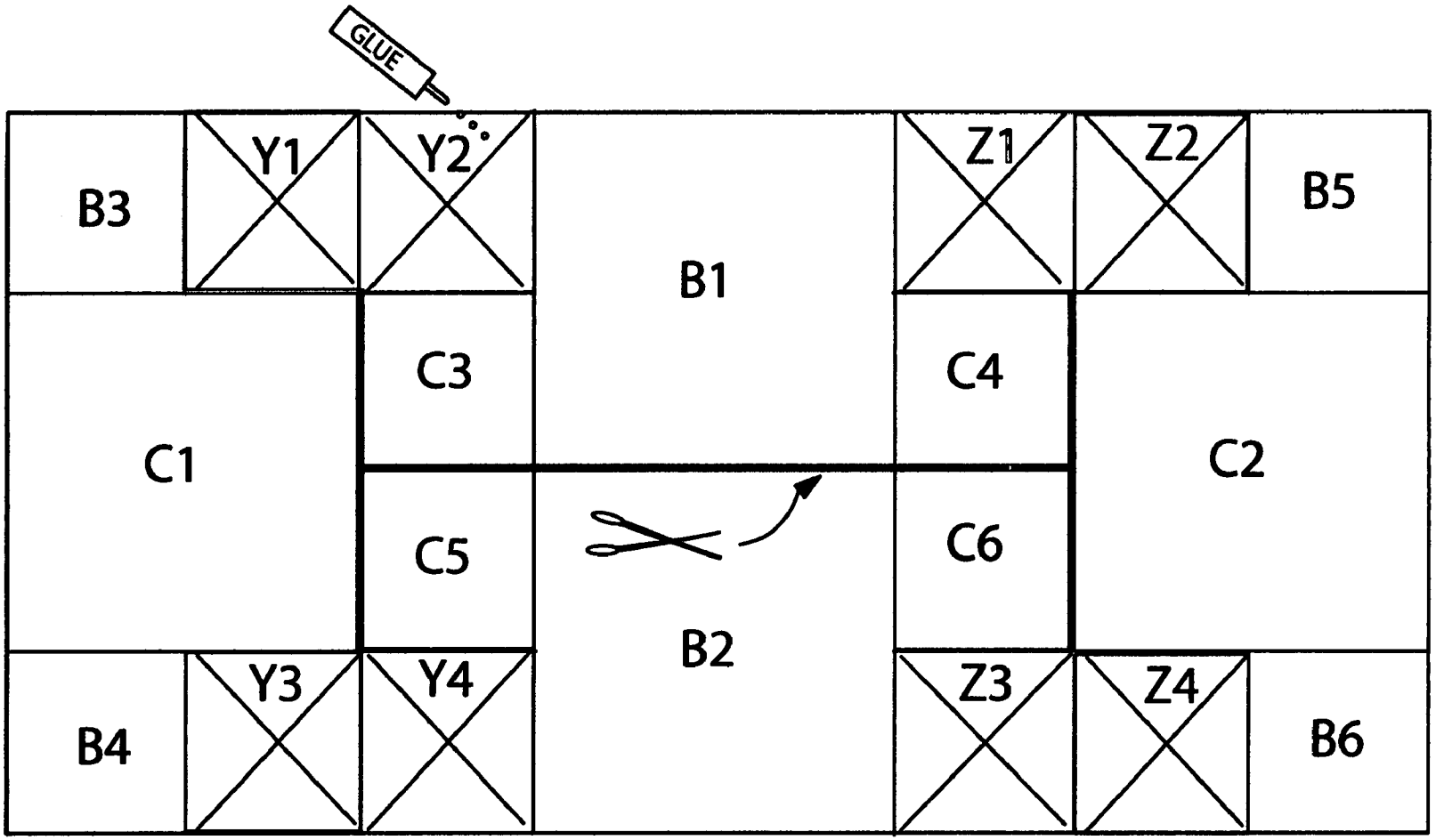
Figure 16:
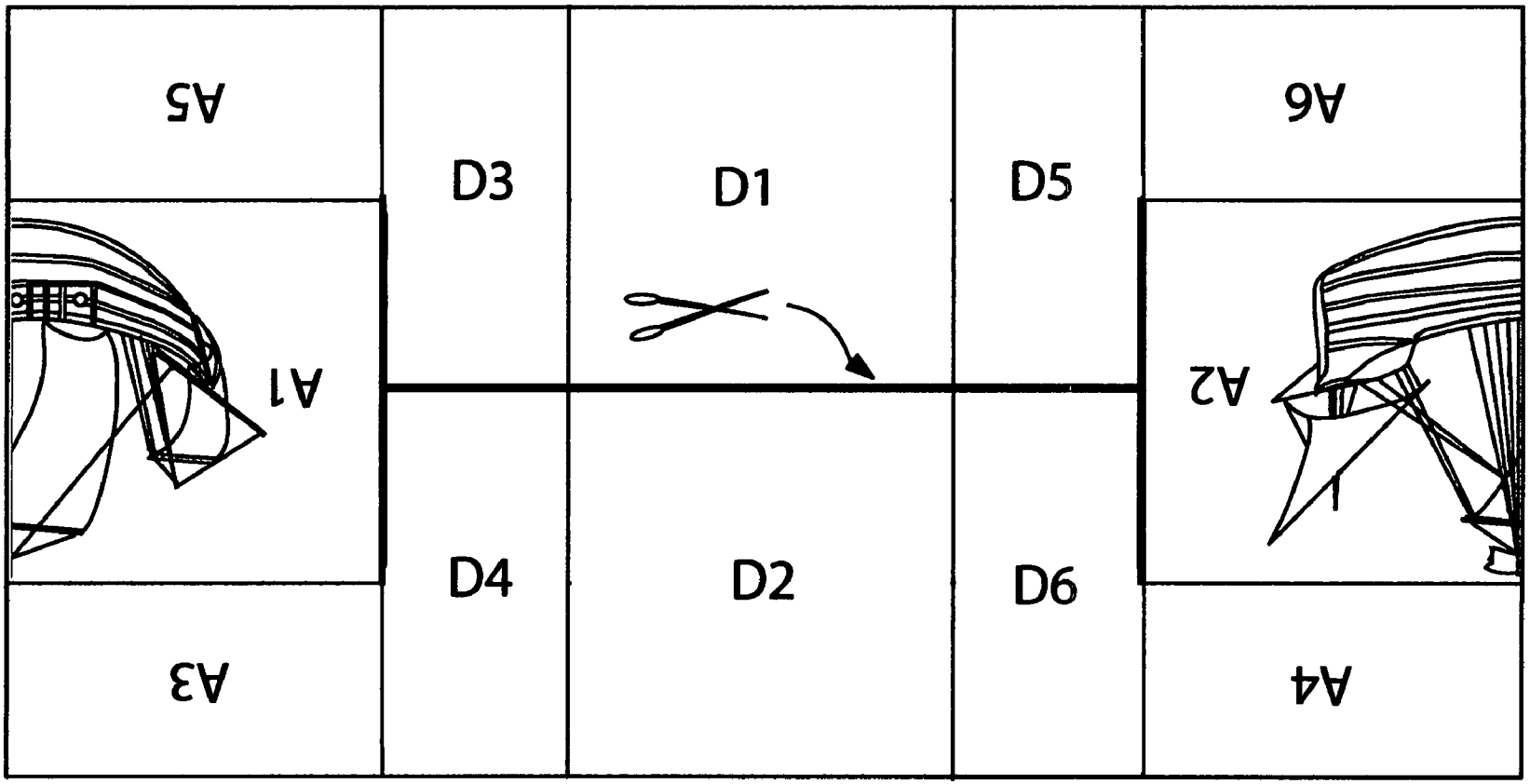
Figure 17:
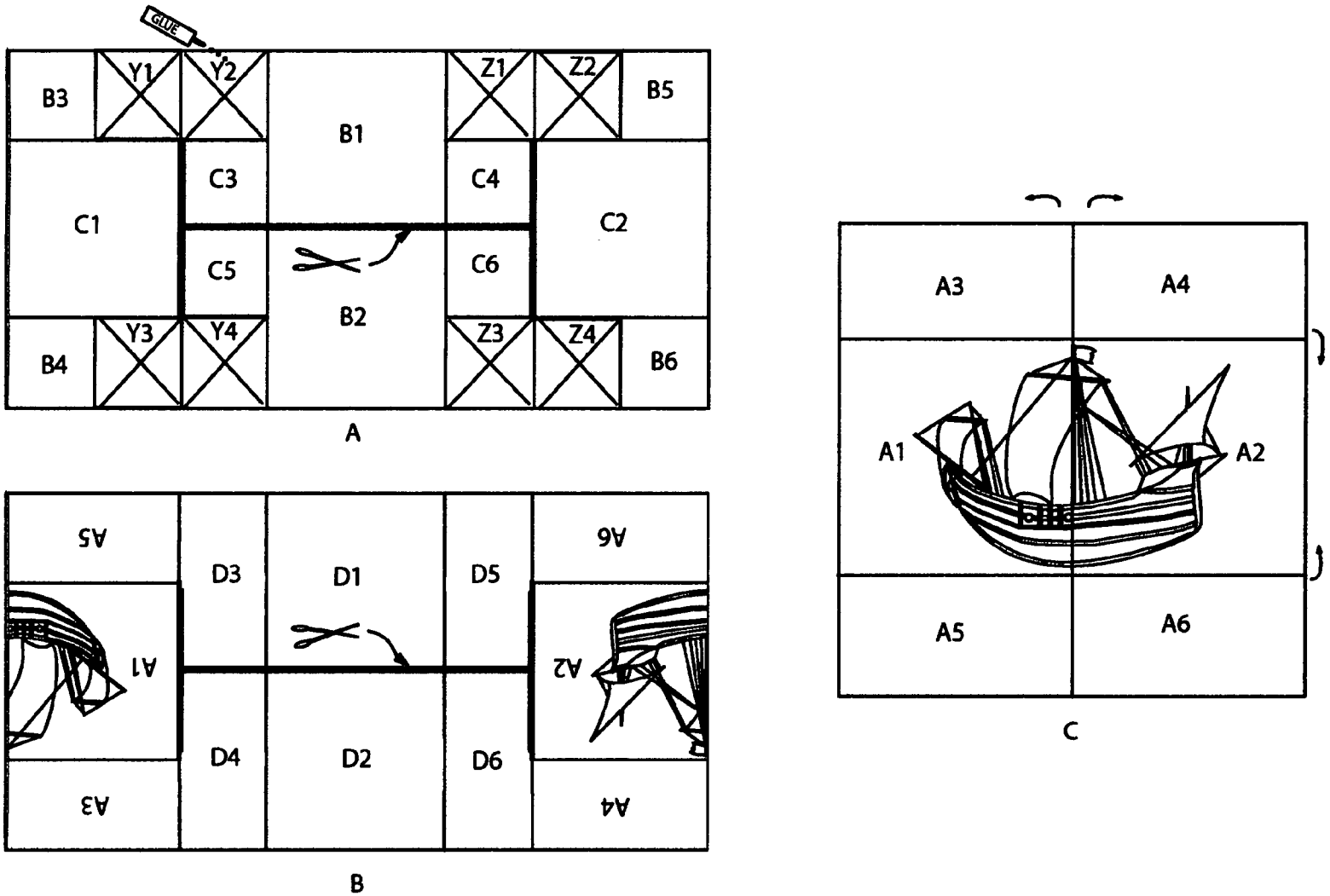
Figure 19:
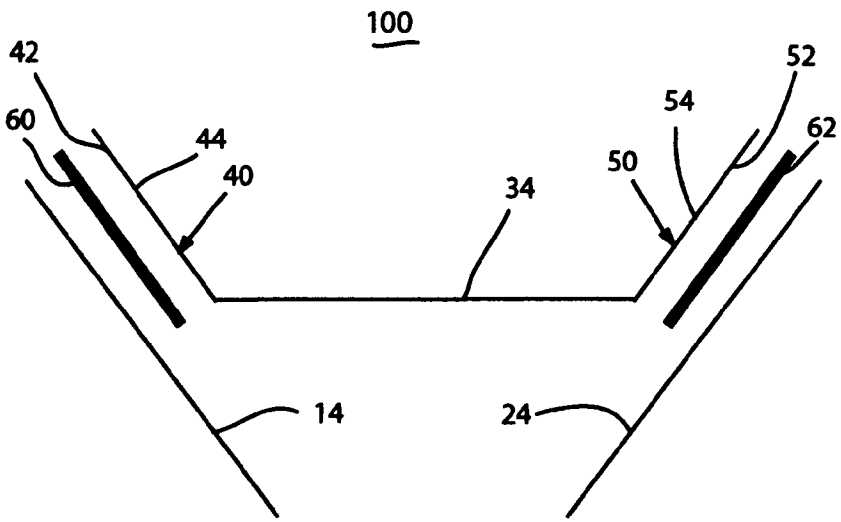
Figure 18:
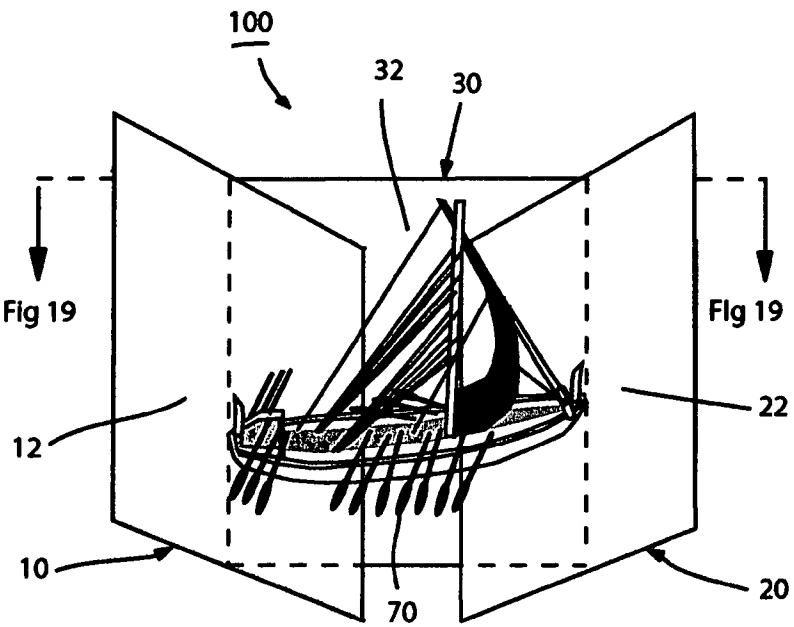

FIG. 10 shows a different sequence of unfolding steps, in which according to its Step 1 the upper and lower quarters are rotated about horizontal fold lines to achieve the configuration shown in FIG. 6; then in its Step 2 the then-side portions are folded back to achieve the configuration shown in FIG. 7; and then in its Step 3 the then upper and lower portions are folded along horizontal lines to achieve the configuration of FIG. 8;

FIG. 11 shows a sequence of unfolding steps when starting from the back side of the assembly;

FIG. 12 shows still a different unfolding sequence starting from the back of the assembly;

FIG. 13 shows a sequence of unfolding steps for a modified embodiment in which the card assembly is relative tall but relatively narrow in a horizontal direction;

FIG. 14 shows a sequence of unfolding steps for another embodiment of the invention in which the card assembly is relatively wide in a horizontal direction but not very tall;

FIG. 15 shows how the embodiment of FIGS. 1–12 can be made from a single rectangular cardboard member, in a folded-out condition showing certain surfaces of the back side that are not normally visible because of being glued together;

FIG. 16 shows how the embodiment of FIGS. 1–12 can be made from a single rectangular cardboard member, being illustrated in a folded-out condition in which both all of the front surfaces of FIG. 1 and all of the back surfaces of FIG. 4 are exposed at the same time;

FIGS. 17A, 17B, and 17C show the complete steps in which the card assembly of FIGS. 1–12 and 15, 16 may be made;

FIG. 18 is a perspective view of the presently preferred embodiment of my invention in a partly folded-out form; and FIG. 19 is a cross-sectional and expanded view of the foldable card assembly of FIG. 18 taken on the line 19—19 of FIG. 18.

DETAILED DESCRIPTION OF FIRST EMBODIMENT

FIGS. 1–12 and 15–17

In the first embodiment of my invention the card assembly is made from a single rectangular piece of cardboard of which the rearward or back surface is shown in FIG. 17A while the front or forward surface is shown in FIG. 17B. Heavy black lines indicate that the cardboard is cut on those lines. This is schematically illustrated by a pair of scissors and associated arrow pointing to one of the black lines.

The sole cardboard member of my first embodiment is functionally divided into 32 sections or panels, 20 of which are visible on the back side as shown in FIG. 17A while the remaining 12 are visible on the front side as shown in FIG. 17B. The view of the front side of the sole cardboard member as seen in FIG. 17B is inverted or rotated about its longitudinal axis relative to the back side as seen in FIG. 17A.

A longitudinal cut line is made which, as shown in FIG. 17A, separates panels C3, B1, and C4 above the line from panels C5, B2, and C6 which are below the line. Panels B1 and B2 are of the same size and shape. The very same cut line is visible in FIG. 17B from the front side of the cardboard where panels D3, D1, and D5 above the line are separated from panels D4, D2, and D6 below the line. The longitudinal cut line extends exactly one-half the length of the cardboard member.

Two other cut lines are also made in the sole cardboard member of my first embodiment, which are perpendicular to the cut line initially described. One of them separates panel C1 from panels C3 and C5 as seen in FIG. 17A, and panel A1 from panels D3 and D4 as seen in FIG. 17B. The other of those cut lines separates panels C4 and C6 from panel C2 as seen in FIG. 17A, and panel A2 from panels D5 and D6 as seen in FIG. 17B.

Eight of the 32 separately identifiable panels are not visible in the operating condition of the product, because they are glued together, in pairs, in face-to-face relationship. FIG. 17C shows the front side of the completed assembly, the same as is shown in FIG. 1. In order to arrive at the completed assembly as shown in FIG. 17C, upon starting with the back side of the sole cardboard member exposed as shown in FIG. 17A, certain folding and gluing operations are performed. One section of the cardboard member consisting of panels B3, C1, and B4 can be folded relative to the remainder of the cardboard member, because of the cut line that was previously made between panels C1 and panels C3, C5. And another section consisting of panels B5, C2, and B6 can be folded relative to the remainder of the cardboard member because of the cut line that was previously made between panels C2 and C4,C6. Thus there are a total of eight folds, four of which are made longitudinally while the other four are made transversely.

After all those fold lines are formed the gluing operations will next be done. Panels Y1 and Y2 are glued together in face-to-face relationship. Panels Y3 and Y4 are glued together in face-to-face relationship. Panels Z1 and Z2 are glued together in face-to-face relationship. And panels Z3 and Z4 are glued together in face-to-face relationship. Then the entire lateral ends of the cardboard member are folded inward so that the front face appears as is shown in FIG. 17C.

DESCRIPTION OF SECOND AND THIRD EMBODIMENTS

FIGS. 13 and 14

The embodiments of FIGS. 13 and 14 are constructed in the same manner as the first embodiment, except that a cardboard member of a different rectangular configuration is used. It will of course be understood that the rectangular cardboard member could, if desired, be actually square.

DESCRIPTION OF PREFERRED EMBODIMENT

FIGS. 18 and 19

According to the present invention I provide a foldable card assembly 100 comprising a generally rectangular front card member that is divided to form two separate front card pieces 10 and 20 of equal size and shape, and a back support card member 30 of essentially the same size and shape as each of the separate front card pieces. The back support card member has its respective side edges hingedly secured to the lateral centers of respective ones of the front card pieces, as indicated by dotted lines in FIG. 18. The front card pieces normally occupy a common plane in front of the back card member, but may be rotated relative to each other and to the back card member. In FIG. 18 the front card pieces are shown in partially rotated position. When fully rotated by one hundred eighty degrees relative to each other and to the back card support member, they would then occupy a common plane behind the back support card member.

FIG. 19 is a horizontal cross-sectional view taken on the line 19—19 of FIG. 18, showing the complete structure in more detail and in a slightly expanded form for purpose of illustration. Left front panel 10 has a front surface 12 and a back surface 14. Right front panel 20 has a front surface 22 and back surface 24. Back support card member 30 has a front surface 32 and a back surface 34. As seen in FIG. 19, the back support member 30 also has a left extension panel 40 with front surface 42 and back surface 44. It also has a right extension panel 50 with front surface 52 and back surface 54.

The front surface 42 of back extension 40 is glued by a glue layer 60 to half of the back surface 14 of front side piece 10. The front surface 52 is glued by a glue layer 62 to half of the back surface 24 of front side piece 20. The back card support member is folded on the dotted lines shown in FIG. 18, in order to provide hinges to support the the front panel 10, 20. It is important to use cardboard material or the like, that will fold well but still be reusable for a number of times.

When the front side pieces 10, 20, are fully rotated by one hundred eighty degrees relative to each other and to the back support member 30, the picture 70 on the front surface 32 of the central back support member 30 will then be fully exposed to view. The back surfaces 44 and 54 of the back support extensions will then be in face-to-face engagement with the back surface 34 of the back support card member 30.

It is convenient to visibly display a first photo as a unit on the front card member, with two separate portions of the first photo being then supported on respective front card pieces. At the same time a second photo may be displayed on the back surface of the back card member. Then when the front card pieces are rotated by one hundred eighty degrees relative to each other and to the back card member, the front surface of the back card support member together with the now forwardly exposed surfaces of the adjacent inner portions of the front card pieces may collectively support a third photo visibly displayed as a unit.

According to the invention the preferred method of providing hinged support by the back support card member for the front card pieces is to provide the back support member with protruding ends that protrude beyond the hinge lines, to fold the back support member along the hinge lines, and then to glue or otherwise secure the protruding end portions of the back support card member to the back surfaces of respective outer portions of the front card member. As a result, there are then two areas on the back surfaces of the respective front card pieces, and two areas on the front surface of the respective protruding portions of the back support card member, that will not be used to support a photo or the like. Their surfaces will not be visible to the user of the product because they are secured together in a face-to-face engagement.

In the preferred embodiment of my invention a feature of particular interest is that a wallet-size photo holder may be used to display two photos that are readily visible, plus another that is normally hidden from view. Although the extension panels 40 and 50 are illustrated in FIG. 19 as being secured to the respective outer portions of the front pieces 10, 20, they may optionally be secured to respective inner portions of the front pieces 10, 20. In the first instance the hidden photo or picture such as 70 may be exposed on surfaces 32, 14, 24. In the latter instance the picture would be displayed on surfaces 32, 42, 52.

Other features of my invention provide other folding actions to make it possible for the same easily transportable package to visibly display selected ones of more than three different photos or the like, as shown in FIGS. 1–12 and 15–17.

Other modifications within the scope of our inventive concept will be apparent to those persons skilled in the art. Although the presently preferred embodiment of the invention has been disclosed in detail in order to comply with requirements of the patent laws, it will be understood that the scope of the invention is to be measured only in accordance with the appended claims.

What I claim is:

1. An elongated rectangular card member for selectively displaying photos having a central portion and two end portions, each end portion comprising a quarter of the length of the card member and the two end portions being foldable inwardly into abutting relationship with each other so as to cover the central portion of the card member, the central portion being rectangular and having a securement area on each of the four corners of its front surface, each securement area being rectangular and one-quarter of the length and one-quarter of the width of the central portion of the card member;

each end portion of the card being folded over the central portion of the card member and being secured by gluing to the two associated securement areas of the central portion of the card member to form an operable photo display assembly;

the entire photo display assembly thus formed including bath the central portion and the end portions of the card member being foldable both longitudinally and transversely along abutting edges of the four securement areas.

2. A display assembly for selectively displaying a normally hidden photo comprising:

a generally rectangular card member folded on parallel lines three-eighths of its length from each of its ends to permit bending movements relative to the remaining one-quarter length central portion of the card member;

the card member further being permanently folded on lines one-quarter of its length from each of its ends, the thus-folded end portions being folded towards each other and also towards the respective immediately adjacent one-eighth length portions of the card member;

each thus-formed one-eighth length portion of the card member being permanently secured in face-to-face engagement with the associated one-quarter length end portion; and the end portions and their associated one-eighth length portions being swingable together along the respective bending lines by one hundred eighty degrees relative to the card central portion;

whereby a photo that is to be normally hidden may be positioned either on the central card portion and its contiguous one-eighth length portions, or else on the central card portion and the uncovered adjacent but non-contiguous surfaces of the respective end portions.

* * * * *